US005335820A

United States Patent [19]

Christianson

[11] Patent Number: 5,335,820

[45] Date of Patent: Aug. 9, 1994

[54] CONTAINER AND DISPENSER SYSTEM FOR FLOWABLE SOLIDS

[75] Inventor: Lee O. Christianson, Willmar, Minn.

[73] Assignee: Christianson Systems, Inc., Blomkest, Minn.

[21] Appl. No.: 23,355

[22] Filed: Feb. 26, 1993

[51] Int. Cl.[5] ..... B65D 35/56

[52] U.S. Cl. ..... 222/105; 222/386.5

[58] Field of Search ..... 222/95, 94, 105, 131, 222/185, 381.5, 389, 120.36, 183; 220/666; 229/120.36

[56] References Cited

U.S. PATENT DOCUMENTS

| | | | |
|---|---|---|---|
| 2,946,626 | 7/1960 | Atkinson et al. | 406/172 |
| 2,956,839 | 10/1960 | Hermanns | 222/389 |
| 3,294,289 | 12/1966 | Bayne et al. | 222/95 |
| 3,318,473 | 5/1967 | Jones et al. | 206/511 |
| 3,372,725 | 3/1968 | Voorhees | 137/585 |
| 3,384,106 | 5/1968 | Isbrandtsen | 137/269 |
| 3,460,718 | 8/1969 | Plant | 206/511 |
| 3,583,910 | 6/1971 | Stoddard | 210/46 |
| 3,955,236 | 5/1976 | Mekelburg | 15/314 |
| 4,186,841 | 2/1980 | Buckley et al. | 220/6 |
| 4,397,406 | 8/1983 | Croley | 222/185 |
| 4,503,786 | 3/1985 | Tautfest | 111/86 |
| 4,796,788 | 1/1989 | Bond | 222/95 |
| 4,846,608 | 7/1989 | Sanders | 222/105 |
| 4,857,055 | 8/1989 | Wang | 222/95 |
| 4,966,310 | 10/1990 | Hawkins | 141/10 |
| 5,096,092 | 3/1992 | Devine | 222/386.5 |
| 5,168,906 | 12/1992 | Combrink | 141/10 |

FOREIGN PATENT DOCUMENTS

| | | | |
|---|---|---|---|
| 2633593 | 1/1990 | France . | |
| 2643887 | 9/1990 | France . | |
| 1241162 | 7/1971 | United Kingdom | 222/386.5 |
| 1293750 | 10/1972 | United Kingdom | 220/401 |
| 2232965A | 1/1991 | United Kingdom . | |

OTHER PUBLICATIONS

Christianson Systems, Inc., *Brochure for Pneumatic Conveying Seed Filler TM System*, 2 pages, 1991 (no date).

Christianson Systems, Inc., *Brochure for Pneumatic Conveying Seed Filler TM System*, 5 pages, 1991 (no date).

*Total Concept in Bulkhandling and Process Control*, published at least as early as Aug. 12, 1991 by tbma Europe bv (no date).

Sales Brochure for Metalfab, Inc., Bulk Bag Unloader (no date).

Sales brochure for B.A.G. Equipment Corp. (no date).

Sales brochure for Custom Packaging System, Inc.; Rhino Bulk Bags & Liners (no date).

*Primary Examiner*—Andres Kashnikow

*Assistant Examiner*—Philippe Derakshani

*Attorney, Agent, or Firm*—Merchant, Gould, Smith, Edell, Welter & Schmidt

[57] ABSTRACT

A container arrangement for storage in dispensing a flowable particulate material is provided. The container arrangement comprises a container including a bottom and a wall with a lower dispensing aperture. Arrangements are provided for selectively erecting a slanted dispensing surface operably positioned underneath particulate material received in the container. The dispensing surface, when erected, is positioned above the container bottom and slanted downwardly toward the wall having a lower dispensing aperture therein. Various arrangements for constructing the dispensing surface are provided. A method for dispensing particulate material from a container is also provided.

17 Claims, 6 Drawing Sheets

CONTAINER AND DISPENSER SYSTEM FOR FLOWABLE SOLIDS

FIELD OF THE INVENTION

The present invention relates to containers, such as shipping or storage containers, for flowable solids. In particular, the invention concerns arrangements for dispensing of flowable solids from within such containers. The invention also concerns methods of providing for dispensing of solid material from shipping or storage containers.

BACKGROUND OF THE INVENTION

A wide variety of flowable solid materials are regularly stored and shipped in large containers. The term "flowable solid materials" and variants thereof, in this context, is meant to refer to any solid, particulate, material which can flow, for example, under the influence of gravity. Such materials include, for example: finely granulated pesticides and insecticides; seed material such as corn; foodstuffs such as various grains; synthetic plastic pellets and granules and, various mineral products.

Flowable particulates are often shipped and/or stored in large containers. A wide variety of large shipping and storage containers have been used. These include, for example: barrels; large plastic bags stored within barrels; large cartons; large plastic bags positioned within cartons; large flexible sacks made of various fabrics, plastics, paper materials, or laminates; and, boxes of wood, fiberboard, plastic or laminates.

The principles of the present invention generally relate to arrangements for facilitating the dispensing of solid materials from various storage containers. Problems generally addressed by arrangements according to the present invention, will be understood by first considering a conventional storage system using a flexible plastic bag containing flowable solids material, stored within a large carton.

Consider for example a seed corn delivery involving storage of the seed corn within a flexible plastic bag, the flexible plastic bag being shipped contained within a large plastic or cardboard shipping container. A typical container or box might be on the order of about four to five feet deep, and three to five feet square. Such a container might hold, for example, 2000 pounds of flowable seed corn.

Such a container would typically be shipped stored upon a forklift pallet or the like. When delivered to a farm or farm supply, it would be offloaded from the truck or railroad train using a forklift. A problem then remains as to how to dispense the particulate material from within the container.

One possible system is to open up the top of the container and remove the solid particulate material through the open top. The present invention concerns alternatives to such systems, for avoidance of the equipment and inconvenience associated therewith and to enhance safety.

In some systems a spout may be provided in the bottom of the internal bag and the container. The solid particulate material can be removed through the spout under the influence of gravity. However, at some point, free flow of the solid material will empty the bag, and will require that the box be tipped, in the direction of the spout. Since the container may be rather large, and would involve a substantial weight of material, this tipping cannot be easily controlled or effected. The present invention is intended to avoid conventional gravity systems wherein a tipping of the carton is needed, to obtain convenient pouring of a solids material.

SUMMARY OF THE INVENTION

According to the present invention a container arrangement of storage and dispensing of flowable particulate material is provided. The container arrangement comprises a container including a bottom, and a wall with a lower dispensing aperture therein. The container arrangement also includes means for selectively erecting a slanted dispensing surface operably positioned underneath particulate material received within the container. The dispensing surface, when erected, is positioned above the container bottom wall and is oriented to dispense particulate material within the container downwardly toward the wall having the lower dispensing aperture therein, under influence of gravity. In selected embodiments, the means for selectively erecting a slanted dispensing surface comprises an inflatable bladder positioned within the container and oriented for selective inflation. The inflatable bladder generally comprises a gas bag constructed and arranged to form the appropriate slanted dispensing surface, when inflated. The arrangement should be constructed such that the slanted dispensing surface will, preferably, form an angle of decline of at least 20°, and for certain applications at least 40°.

In some embodiments the means for selectively erecting a slanted dispensing surface underneath particulate material comprises a construction including a pedestal frame work and a flow surface arrangement. The pedestal framework for such arrangements generally comprises a support frame for holding the flow surface arrangement with a dispensing surface thereof slanted downwardly toward the lower dispensing aperture in the wall.

In the various embodiments, the dispensing surface may be contoured, and include a plurality of angled flow surfaces therein.

In some embodiments, the pedestal framework may comprise a plurality of longitudinal guide supports, supported by a plurality of cross-supports, the longitudinal guide supports being engaged by the cross supports utilizing a slotted engagement arrangement, to facilitate erection and knock-down.

In various container arrangements according to the present invention, flexible bags may be utilized to contain solid particulate material. In general, such flexible bag arrangements would include dispensing spouts therein, and lower portions thereof, aligned with the dispensing aperture in the container side wall.

According to the present invention, a method is provided of dispensing flow of a particulate material from a container. The method generally includes a step of inflating a bladder arrangement positioned within the container underneath the flow of particulate material, in a manner biasing the particulate material outwardly from the container. In general, the method comprises inflating the bladder arrangement such that a slanted flow surface is generated underneath the particulate material, directing the particulate material toward a dispensing aperture in a side wall of the container.

BRIEF DESCRIPTION OF THE DRAWINGS

FIG. 4 being from a view generally analogous to FIGS. 2 and 3.

DETAILED DESCRIPTION OF THE INVENTION

The principles of the present invention may be applied in a variety of storage and shipping arrangements. Herein multiple alternative embodiments are described. From these descriptions the wide applicability of principles of the present invention will be generally understood.

FIGS. 1-3

Figure 1:
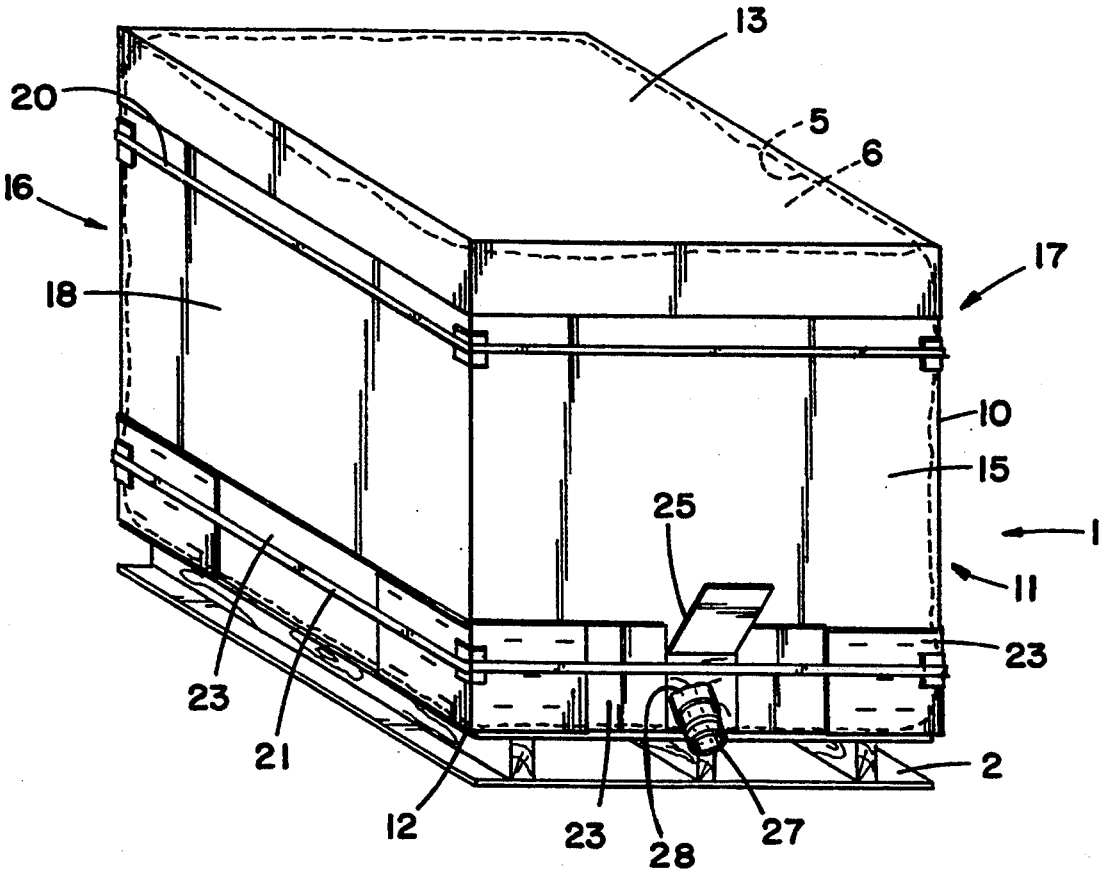
FIG. 1 is a front perspective view of a container system according to the present invention, with a selected internal portion shown in phantom.
Figure 2:
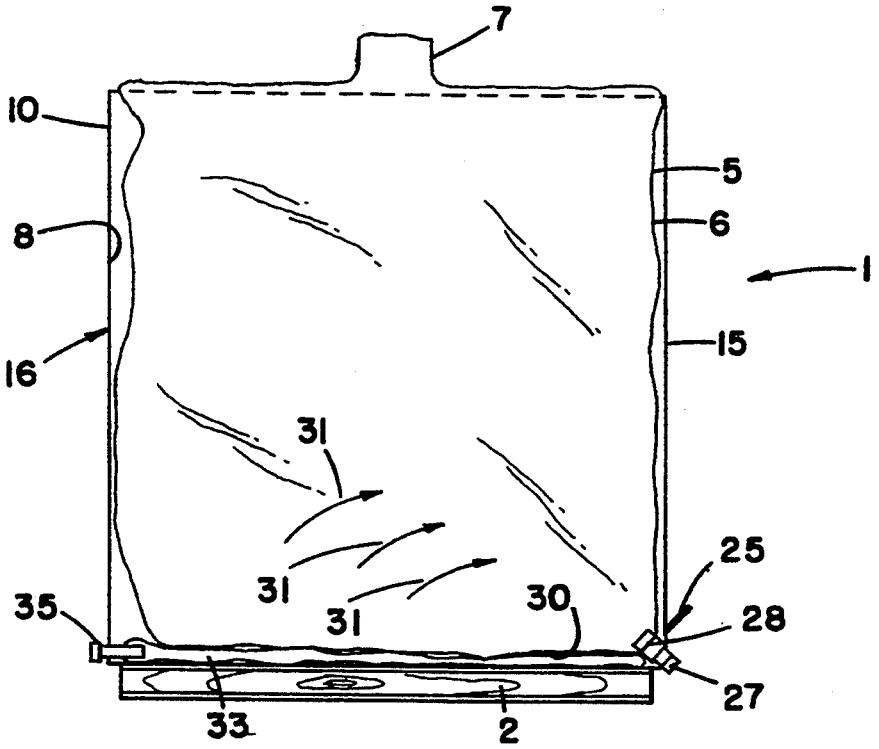
FIG. 2 is a side elevational view of the arrangement shown of FIG. 1, with a side panel broken away to provide viewing of internal components and with a cover removed.
Figure 3:
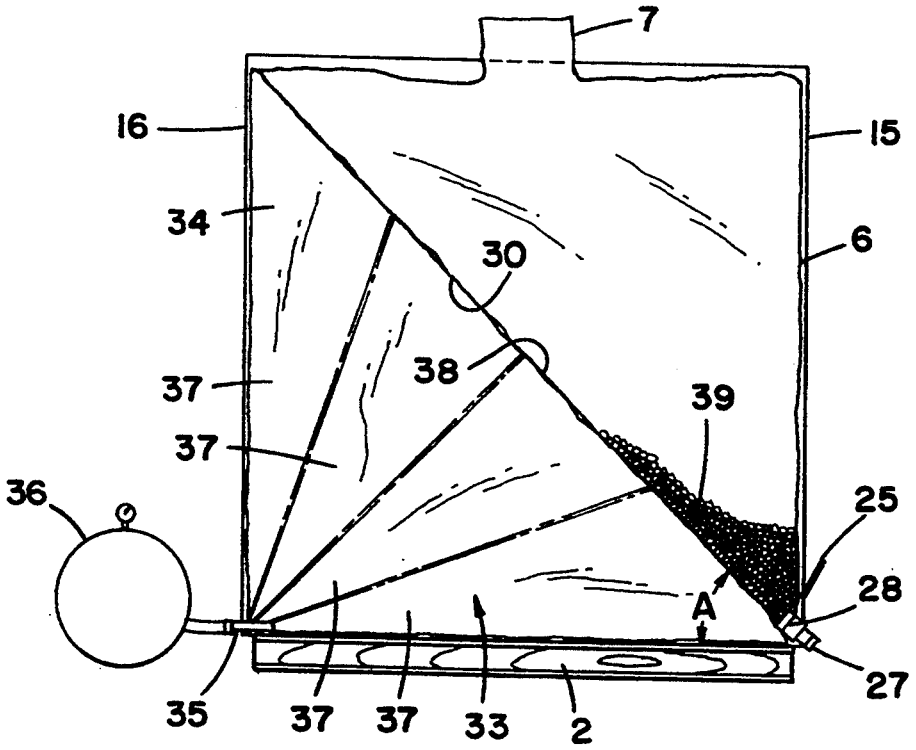
FIG. 3 is a side elevational view generally analogous to FIG. 2; the arrangement in FIG. 3 being depicted during operation for removal of solids material therefrom.

A first container arrangement according to the present invention is generally depicted in FIGS. 1-3. The reference number 1, FIG. 1, generally represents a shipping or storage container which has been modified according to the principles of the present invention, to advantage. Referring to FIG. 1, container 1 is shown positioned on a pallet 2 so that it can be easily maneuvered utilizing a forklift or the like.

An internal flexible container 5 is positioned within container 1. For the arrangement shown, internal flexible container 5 comprises a large plastic bag 6, which lines an interior 8 (FIG. 2) of container 1. Flowable particulate material (such as seed corn or chemicals) to be stored or shipped utilizing container 1, is generally contained within plastic bag 6. Bag 6 includes a cover with a filling spout 7 therein, for easy filling.

A wide variety of constructions may be utilized for storage or shipping container 1. The arrangement shown in FIG. 1, comprises a fiberboard box 10 including side wall construction 11, bottom 12 and cover 13. Access to interior 8 of shipping container 1, is generally through cover 13. Cover 13 can simply be removed from side wall construction 11 by lifting same.

Referring to FIGS. 1 and 2, side wall construction 11 includes front panel or wall 15, opposite rear panel or wall 16, and side panels or walls 17 and 18 respectively. In FIG. 2, container 1 is shown with side panel 17 shown broken away, so that bag 6 and other items within interior 8 can be viewed. In addition, in FIG. 2 arrangement 1 is depicted with cover 13 removed.

Still referring to FIG. 1, fiberboard box 10 is reinforced with metal bands 20 and 21, extending circumferentially therearound. (Metal bands, not shown, wrapped vertically around the arrangement would be used in addition, for shipping.) Lower portions of box 10 are reinforced with fiberboard panels 23, in a conventional manner.

Referring still to FIG. 1, front panel 15 includes a door or flap 25 in a lower portion thereof, by which access to a lower portion of interior 8 is provided. In the vicinity of flap 25, plastic bag 6 is provided with an openable spout 27, which can be pulled through dispensing aperture or opening 28, under flap 25, and opened to release or dispense particulate material contained within bag 6.

When it is desired to dispense particulate material from within bag 6, spout 27 is pulled through opening 28, and is opened. The particulate material will then begin to flow out of spout 27 under gravity influence. If a conventional means of dispensing material were utilized, container 1 would be tipped forward, to facilitate the gravity flow of the particulate material.

The present invention concerns means to facilitate flow of particulate material outwardly through spout 27, without tipping the entire container 1. In this manner, safety is facilitated and heavy equipment needed to accomplish the tipping is avoided. In particular, arrangements according to the present invention are provided with means for selectively erecting a slanted dispensing surface operably positioned underneath particulate material received within the container. The dispensing surface, when erected, is positioned above the container bottom wall. In addition, the slanted dispensing surface, when erected, is oriented to dispense particulate material within the container downwardly toward the lower dispensing aperture, under influence of gravity, to facilitate dispensing of particulate material out of the container. Herein the term "means for selectively erecting a slanted dispensing surface" is not considered definitive of whether or not the slanted dispensing surface is erected before or after the container is filled or partially filled with particulate material. Arrangements wherein the slanted dispensing surfaces erected after particulate material is placed within the container, are described and shown. Also, herein arrangements wherein the slanted dispensing surface is constructed before the particulate material is placed within the container are also shown.

Referring to FIG. 2, for the embodiment shown in FIGS. 1-3, container 1 is provided with internal means for biasing particulate material received within a bottom container 1 in the general direction indicated by arrows 31, when selectively operated. This biasing will tend to direct flow of the particulate material downwardly toward aperture 28 and will facilitate flow of granular material outwardly through spout 27, without a need for tipping the entire container 1. For the embodiment shown, this means for biasing operates to bias bottom wall 30 of bag 6.

The means for biasing bottom wall 30 of bag 6 comprises a selectively inflatable bladder arrangement 33. Referring to FIG. 3, bladder arrangement 33 comprises an inflatable gas bag 34. Gas bag 34 is selectively inflatable through nozzle arrangement 35. In FIG. 3, gas bag 34 is shown attached to a source 36 of compressed air for inflation. It will be understood that a variety of means of inflation may be utilized including, for example, compressed gas cylinders and direct connection to compressors. In some instances it may be desirable to provide portable gas cylinders attached to the container 1 or the pallet 2. In other instances, cylinders or compressors on site may be utilized.

In preferred applications, inflatable gas bag 34 will generally be configured to be substantially triangular in side elevation or cross-section, as shown in FIG. 3, when inflated. Thus, the preferred embodiment's bag 34 will form, when inflated, a downwardly slanted upper dispensing surface or wall 38; bag 34 being configured such that (when inflated) surface 38 is slanted downwardly toward wall 15 and with the downward slant directed toward spout 27. For the arrangement shown in FIGS. 2 and 3, gas bag 34 is provided with a plurality of individual chambers 37 to achieve this configuration. It is noted that dispensing surface 38 may be contoured to provide preferred flow, for example a funneling toward aperture 28. Gas bag 34 may be constructed from a variety of materials including rubber and rubberized materials, from which heavy duty inflatable items such as heavy duty air cushions, inflatable boats and inflatable furniture are constructed. In general, what is necessary is that the material be sufficiently flexible and strong for the use intended.

Nozzle arrangement 35 may be provided with a variety of valve systems or the like therein, to facilitate inflation, obtain maintenance of bag 34 in an inflated condition, and deflation. Conventional valve systems may be utilized. In addition, a variety of coupling arrangements, not detailed, to facilitate attachment to inflation systems may be utilized. Conventional air hose valves and couplings can be readily adapted for use with gas bags according to the present invention.

Operation of the assembly depicted in FIGS. 1–3 will be readily understood by review of these figures. It is foreseen that container 1 will be filled with inflatable bag 34 appropriately positioned and collapsed in the bottom thereof and oriented such that (when inflated) wall 38 will be appropriately directed. Nozzle 35 would be extended through a portion of container 1, for access by inflation means. For the arrangement shown in FIGS. 1–3, nozzle 35 extends outwardly through back wall 16.

Internal bag 6 will be positioned in container 1 full of flowable particulate material 39. It is foreseen that in some instances bag 6 will be filled with flowable particulate before it is placed within container 1 and in others bag 6 will be positioned within container 1 as a liner, and then be filled from various filling equipment. Typically for shipping or long term storage, bag 6 will be closed on the top, for example, with a tie, and container 1 will be covered by cover 13.

When dispensing through spout 27 is desired, spout 27 will be accessed through front wall 15, for example by opening flap 25 and pulling spout 27 through aperture 28. Spout 27 would then be opened to dispense material. In typical instances, under influence of weight and gravity, some flow of particulate material 39 outwardly from spout 27 may begin, even without inflation of bag 34. However, if not initially, at least at some point flow will stop or slow substantially. At this point, or otherwise as desired, bag 34 will be inflated, as shown in FIG. 3, for example by attachment of an appropriate inflation means 36. As bag 34 is inflated, wall 38 will begin to push upwardly and forwardly on bottom wall 30 of bag 6. This will tend to direct the particulate material 39 toward wall 15, and increase downward flow toward spout 27 (and aperture 28) facilitating emptying of bag 6. When emptying is completed, bag 34 can be collapsed and used again, either within the same container 1, or after removal and appropriate positioning within a different container.

THE EMBODIMENT OF FIG. 4

As explained generally above, the principles of the present invention may be applied in a variety of systems, concerning a wide variety of flow of particulate materials. It needs to be understood, however, that different particulate material exhibits different propensity to flow, under influence of gravity. This, in general, is characterized by the angle of repose (or slope) of the material. The angle of repose (or slope) is typically defined as the angle of maximum slope at which a heap of a loose solid material will stand, without sliding.

For particulate materials such as a granular insecticides and the like, the angle of repose is relatively high, on the order of about 40 degrees. Thus, in order to achieve efficient emptying of bag 6 and container 1, it will in general be preferred to raise bottom wall 30 of bag 6, and tip same, at an angle on the order of about 40–50 degrees. To effect this, the bag 34 utilized in FIG. 1 is shown constructed to provide, when inflated, an angle of decline A for dispensing surface 38 on the order of at least about 40 degrees, and preferably 40–50 degrees.

Such a high angle of repose, however, is not needed with certain other types of granular material. For example, seed corn exhibits an angle of repose of only about 20–25 degrees. Thus, a bladder or inflatable bag to be utilized with seed corn need not inflate at such a great angle as the arrangement shown in FIGS. 1–3. An alternate arrangement, utilizable with materials having a relatively low angle of repose, is indicated in FIG. 4.

Figure 4:
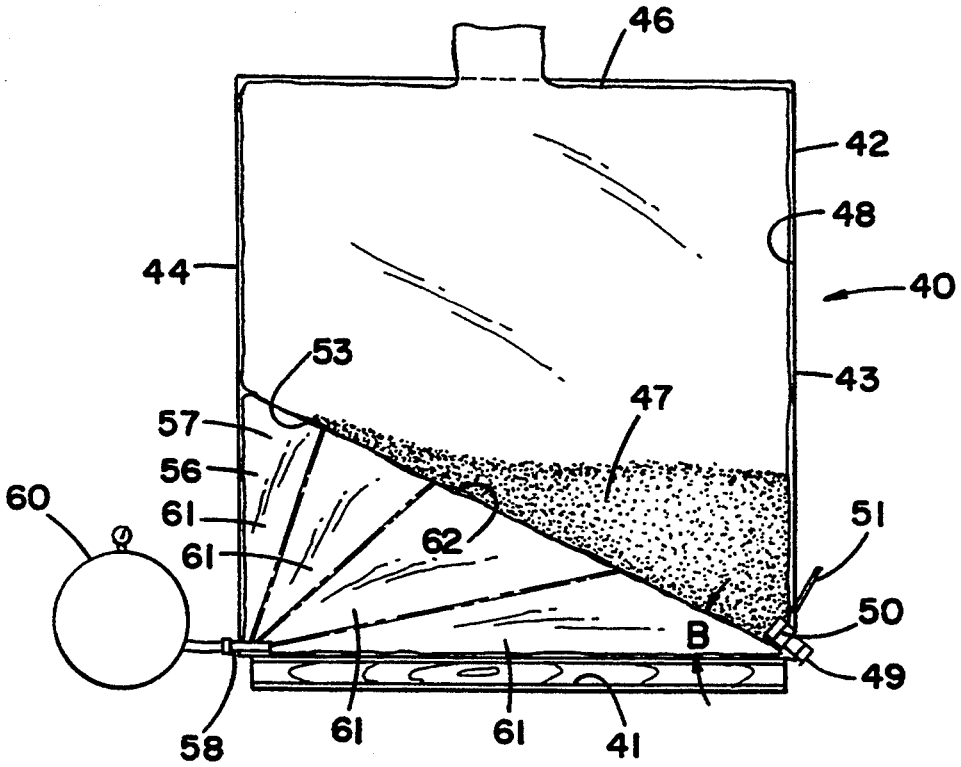
FIG. 4 is a side elevational view of an alternative embodiment according to the present invention.

Except for the angle of repose, the arrangement shown in FIG. 4 is generally analogous to that shown in FIG. 3. FIG. 4, it will be understood, is a depiction of an arrangement generally analogous to the view utilized in FIG. 3, to illustrate this.

Referring to FIG. 4, container 40 is depicted, positioned on pallet 41. Container 40 comprises a box 42 having a front wall 43, an opposite rear wall 44 and side walls, (not shown but analogous to the arrangement shown in FIGS. 1–3).

Bag 46, containing particulate material 47 therein, is shown positioned within interior 48 of box 42. Bag 46 may be identical to bag 6, FIGS. 1–3, if desired. Bag 46 includes lower spout 49 therein, which projects through opening or lower dispensing aperture 50 and front wall 43. Aperture 50 is provided by flap 51.

Bag 46 includes bottom wall 53. According to the present invention means are provided to lift bottom wall 53 and tip same toward spout 47, to facilitate emptying of bag 46.

For the embodiment shown in FIG. 4, means to accomplish the appropriate movement in bottom wall 53 (and material 47) is provided by bladder 56. Bladder 56 may be generally analogous to bladder 33, FIGS. 1-3, and comprise gas bag 57 having inflation nozzle arrangement 58 thereon. Inflation nozzle arrangement 58 is shown attached to source 60 of compressed air, for inflation. Bag 57 includes a plurality of air chambers 61 therein, arranged to achieve the desired geometry when inflated.

Gas bag 57, FIG. 4, is configured such that when inflated, the angle (Angle B) of decline of wall or dispensing surface 62 is at least 20 degrees, and preferably on the order of 20-30 degrees, rather than the relatively high angle (40-50 degrees) for Angle A FIGS. 1-3. 3. Thus, bag 57 will take less volume in the container, and still achieve efficient dispensing of flow of a particulate material 47 through spout 49, provided the particulate material is of a type which flows readily under a relatively low (20-30 degree) angle of repose.

From a comparison of FIGS. 3 and 4, it will be understood that a variety of specific geometries of gas bag arrangements may be utilized to advantage in various systems. In general the gas bag should be provided such that when inflated it will provide an upper wall or slanted dispensing surface above a bottom of the container and slanted downwardly toward the exit spout (and dispensing aperture) at an appropriate angle, for the flow of a particulate material being dispensed. In general angles of at least 20 degrees, and preferably on the order of about 20-30 degrees, will be preferred for such materials as seed corn. Angles on the order of at least 40 degrees, and preferably 40-50 degrees, will be preferred for materials such as pesticides or herbicides. Of course the slanted wall (38, 62) need not be flat, it may be contoured, for example to funnel material toward the exit spout.

In some instances gas bag arrangements may be constructed which allow for inflation to alternative angles, depending on which of a plurality of inflation chambers are inflated. Thus, bag arrangements having multiple inflation nozzles, accessible for variations in inflation, could be utilized in arrangements according to the present invention.

THE ARRANGEMENT OF FIG. 5

Principles of the invention as applied with respect to the embodiments of FIGS. 1-4 are particularly well suited for utilization with a shipping container that has relatively strong, rigid walls. Thus, referring to FIGS. 1-3, for example, when the bladder arrangement 33 is inflated, flow of a particulate material within the internal flexible container 5 is directed toward the front wall or panel 15. The front wall or panel 15 should, preferably, be relatively rigid to resist being bowed outwardly and, potentially, to sag or pull the container 1 over. Thus, the arrangements shown in FIGS. 1-4 are particularly well adapted for utilization with shipping containers that have relatively rigid outer walls, or at least support structures therein to provide support to the outer walls, especially the wall toward which particulate material is directed during operation. This does not mean, however, that the general principles of the present invention cannot be applied to shipping containers that have relatively soft, flexible wall structures. An example of such an application is illustrated in FIG. 5.

Figure 5:
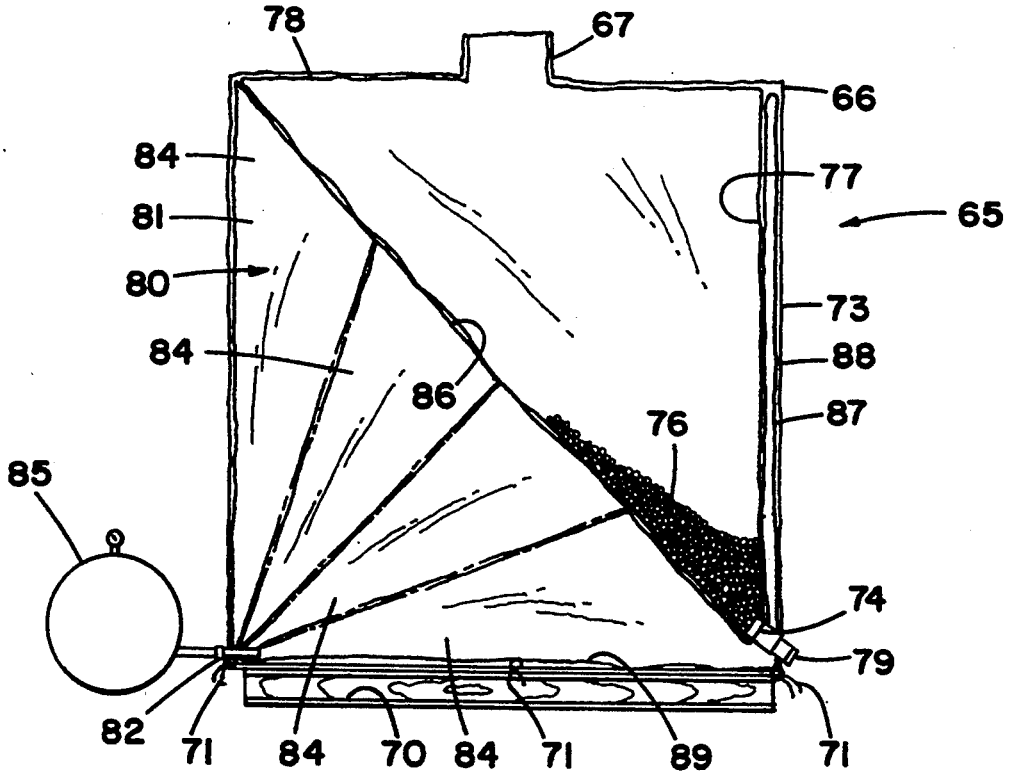
FIG. 5 is a side elevational view generally analogous to FIGS. 2, 3 and 4 of a second alternative embodiment according to the present invention.

Referring to FIG. 5, reference numeral 65 generally indicates a shipping container. Shipping container 65 comprises a flexible walled container 66. Container 66 may be formed from a variety of materials such as fabrics, flexible plastics, laminates or the like. Container 66 includes an upper inlet 67 through which it can be filled with flowable solids, such as seed corn or the like. Of course, the shipping container can also be fork lifted with flexible lifting loops sewn into each top corner of the flexible bag. A wooden pallet is not absolutely necessary.

Shipping container 65 is supported upon a pallet 70, for ease of movement and handling. Since shipping container 65 has relatively flexible walls, to facilitate maintenance of appropriate position on pallet 70, ties 71 are provided. It will be understood that a plurality of ties 71 may be utilized to secure flexible container 66 to the pallet 70. The ties may comprise, for example, extensions of fabric sewn to or otherwise attached to a lower portion of container 66.

Container 66 includes front wall 73 which has lower dispensing aperture 74 for a dispensing spout positioned in a lower portion thereof. Aperture 74 can be tied closed or otherwise secured when it is desired to maintain particulate material 76 within interior 77 of container 66.

It will be understood that the arrangement shown in FIG. 5 can be utilized with or without an internal flexible bag. If utilized with an internal flexible bag, the arrangement of the internal flexible bag would appear somewhat similar to those utilized in FIGS. 1-4, with an internally received flexible bag 78, having a lower spout 79 therein for dispensing of particulate material therefrom. In FIG. 5, the arrangement is shown utilized with an interior flexible bag 78. Operation with respect to means for dispensing, however, would be basically the same even if no internal bag were present. If no internal bag is used, the dispensing spout (79) may comprise a portion of the outer wall (73).

Referring to FIG. 5, bladder arrangement 80 is provided to generate (above the container bottom) a downwardly slanted bottom wall (or dispensing surface) to bias particulate material toward front wall 73, as selected, during dispensing. Bladder 80 may be generally as described above with respect to FIGS. 1-4, except for modifications indicated herein. Thus, similar to the arrangements of FIGS. 1-4, bladder 80 comprises gas bag 81 having an inlet nozzle arrangement 82 selectively attachable to a source 85 of compressed air. Gas bag 81 comprises a plurality of chambers 84 shaped and arranged such that when inflated slanted surface 86 is defined. Slanted surface 86 biases flow of particulate material 76 downwardly toward wall 73 and outlet spout 79. A variety of angles for the slant of surface 86 can be obtained through the design of chambers 84 or overall design of gas bag 81, generally as indicated above with respect to FIGS. 1-4. Preferred angles of the slant of surface 86 were defined above with respect to FIGS. 1-4.

A primary manner in which the bladder 80 of the arrangement shown in FIG. 5 differs from the arrangements of FIGS. 1-4, is that bladder arrangement 80 includes front section 87. Front section 87 comprises inflatable wall 88 which extends upwardly along front wall 73 of flexible container 66. The bladder 80 may be constructed such that inflatable wall 88 can be inflated through nozzle 82, as illustrated, or through alternate means. Inflatable wall 88, once inflated and rendered relatively rigid, will provide support or reinforcement to front wall 73, in order to facilitate resistance to pressure from the particulate material 76, during the dispensing process. Inflatable wall 88 can be readily designed to have an aperture extending therethrough, in the region of spout 79, for passage of particulate material 76 therethrough during dispensing. In some instances side gusset(s), not shown, securing bladder wall 88 to bladder base 89 may be used to help maintain wall 88 upright against pressure from stored particulates.

THE ARRANGEMENT OF FIGS. 6–9

The principles of the present invention as applied to the embodiments of FIGS. 1–5 generally concern arrangements wherein means are provided underneath internally received flow of particulate material, within a shipping or storage container, to facilitate dispensing of particulate material from the container. In general, the means can be selectively actuated to lift a bottom portion of the particulate material upwardly and provide a slanted dispensing surface to direct the particulates toward a dispensing aperture, under the influence of gravity, as desired. Alternately stated, for the embodiments of FIGS. 1–5, the means to direct upward and forward forces on a lower level of particulate material, with or without an internally received bag, are erected after the particulate material occupies the internal volume of the container. For the particular embodiments shown in FIGS. 1–5, this erection is generated by inflation of various bladder arrangements.

It is foreseen that in some instances it may be desirable to preconstruct (or erect) means within the shipping container, to facilitate direction of particulate material therein toward an exit spout. One such arrangement, according to the present invention is illustrated in FIGS. 6–9.

Figure 6:
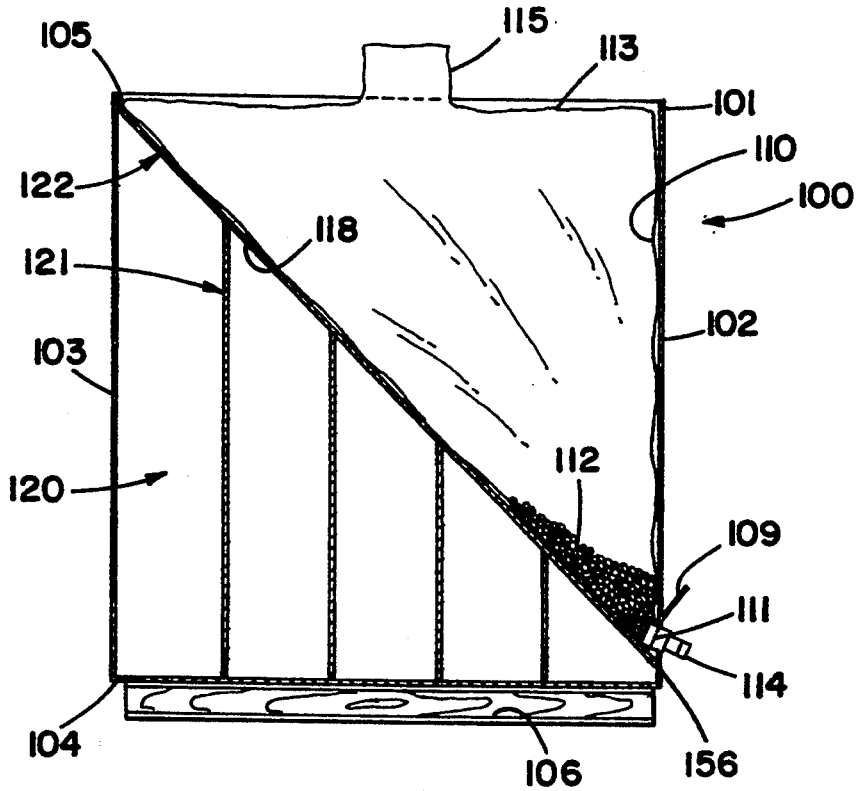
FIG. 6 is a side elevational view, generally analogous to FIGS. 2, 3, 4 and 5, of a third alternative embodiment according to the present invention.

Referring to FIG. 6, a storing or shipping container according to the present invention is generally indicated as 100. Container 100 generally comprises a box 101 having front wall 102, rear wall 103, bottom wall 104 and top 105. Analogously to FIGS. 2, 3 and 4, top 105 is shown open, a cover having been removed. Also, in FIG. 6 the container 100 is depicted with the sidewall and other portions facing the viewer broken away so an interior can be viewed. Container 100 is shown positioned on pallet 106 to facilitate handling.

An exterior view of the arrangement shown in FIG. 6 could, for selected embodiments, be generally analogous to the exterior view illustrated in FIG. 1.

Referring again to FIG. 6, wall 102 includes flap 109 therein for access to container interior 110 through dispensing aperture 111. Flap 109 is located in a bottom portion of wall 102, to facilitate dispensing of particulate material 112 from container 100.

For the embodiment shown in FIG. 6, particulate material 112 is retained within internal bag 113. Bag 113 includes a lower dispensing spout 114 thereon, which can be selectively pulled through opening 111 under flap 109, for dispensing of particulate material 112. Bag 113 also includes an upper filling spout 115.

Bag 113 includes lower wall 118. For the arrangement shown in FIG. 6, shipping container 100 includes means therein for supporting lower wall 118 of bag 113, i.e. supporting the particulate material 112, in a downward slant toward dispensing spout 114. This means comprises rigid arrangement or construction 120.

Rigid construction 120 generally comprises a pedestal framework 121 supporting a dispensing surface, flow surface or biasing surface arrangement 122 thereon. Dispensing surface arrangement 122 is supported in an orientation to direct particulate material 112 as desired, i.e. downwardly toward spout 114.

A variety of means may be utilized to generate construction 120. A particular, advantageous, preferred arrangement for construction 120 is illustrated in FIG. 7.

Figure 7:
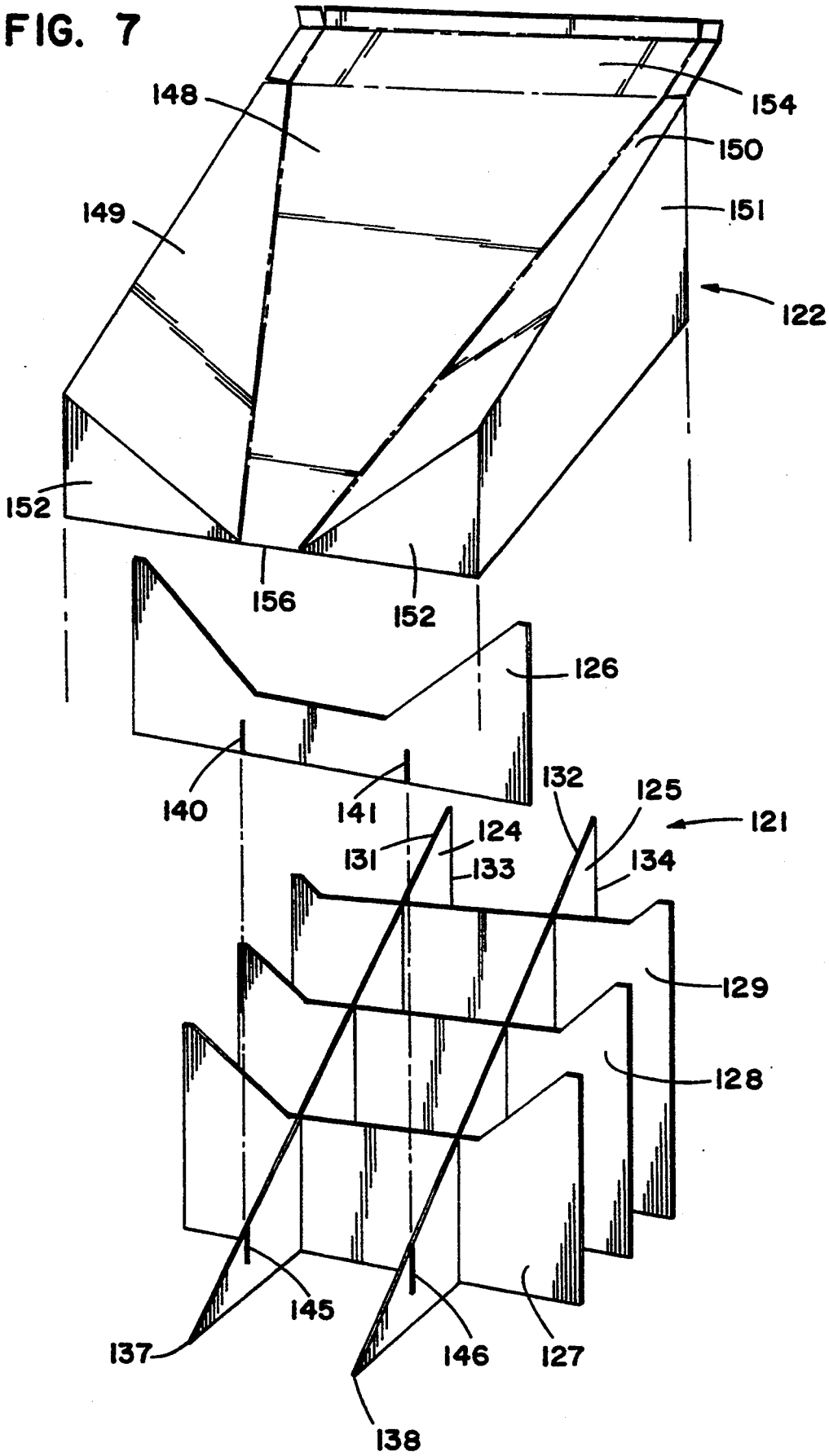
FIG. 7 is an exploded perspective view of an internal construction of the arrangement shown in FIG. 6.
Figure 8:
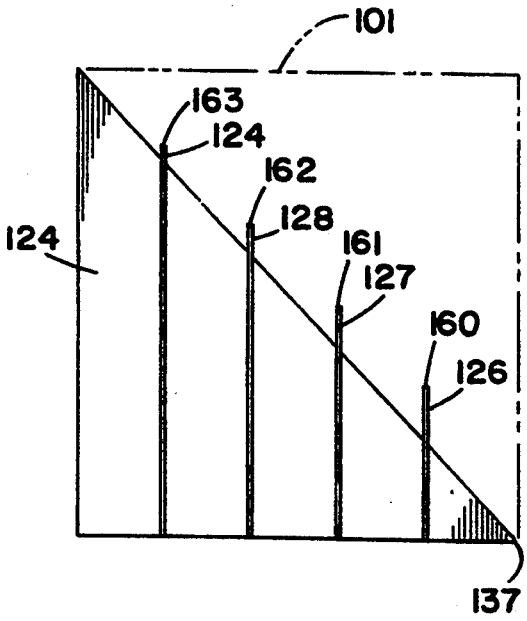
FIG. 8 is a side elevational view of a component of the internal construction shown in FIG. 7.

FIG. 7 is an exploded perspective view of rigid construction 120. Again it will be understood that in general construction 120 comprises pedestal framework 121 having flow surface 122 supported thereon.

While a variety of materials may be utilized to construct rigid construction 120, the arrangement shown in FIG. 7 is particularly well adapted for utilization with fiberboard or the like.

Still referring to FIG. 7, framework 121 comprises longitudinal guide supports 124,125, and cross supports 126,127,128 and 129. Longitudinal guide supports 124 and 125 define upper edges 131 and 132 which slant downwardly from back ends 133 and 134, respectively, toward front ends 137 and 138, respectively. In general, as will be understood by reference to FIG. 6, the downward slant of edges 131 and 132 between back ends 133,134 and front ends 137,138 generally defines the downward slant of flow surface arrangement 122 and particulate material received within the container, toward the dispensing spout.

Cross-supports 126–129 operate to orient longitudinal guide supports 124 and 125 in appropriate positions within container 100, FIG. 6, and with respect to one another. Engagement between the cross supports 126–129 and longitudinal guide supports 124 and 125 may be of a variety of means, the particular arrangement shown in FIG. 7 utilizing a slotted engagement arrangement.

More particularly, referring to FIG. 7, engagement of the various pieces will be understood by reference to cross support 126. Cross support 126 is shown in an exploded view.

Cross-support 126 includes first and second slots 140 and 141 therein. Slots 140 and 141 are oriented appropriately, and spaced apart appropriately, for alignment with slots 145 and 146, in longitudinal guide supports 124 and 125, respectively, when framework 121 is assembled. When assembly is made, the aligned slots slide past one another and engage rigid positions of elements therebehind. It will be understood that similar arrangements of slots can be utilized for engagement of each of cross-supports 127, 128 and 129 with each of longitudinal guide supports 124 and 125.

From a review of FIG. 7, it will be understood that framework 121 can be readily knocked down or disassembled. More specifically, each of the cross-supports 126–129 can be readily (and manually) slid out from engagement with the longitudinal guide supports 124 and 125.

As indicated above, a primary purpose of framework 121 and rigid construction 120, is to support dispensing surface arrangement 122 in an appropriate orientation to guide particulate material toward wall 102, aperture 111 and spout 114, FIG. 6. In FIG. 7, a preferred flow surface arrangement 122 is illustrated. Arrangement 122 comprises a construction having a central dispensing surface or panel 148, upwardly directed dispensing surfaces or flanges 149 and 150, side walls 151, and front panels 152. In addition, the arrangement includes rear flap 154. It will be understood that arrangement 122 may be folded from fiberboard and the like, although alternate constructions can be utilized. In FIG. 6, portions of arrangement 122 are broken away, to facilitate understanding.

As will be understood by reference to FIGS. 6 and 7, arrangement 122 is generally configured such that a slant of upper surfaces of panel 148 (and flanges 149 and 150), downwardly and toward front end 156 is provided. End 156, it will be understood, will generally be oriented in alignment with aperture 111 and dispensing spout 114, FIG. 6. Particulate material resting upon surfaces 148, 149 and 150 (or alternatively within a bag supported on surfaces 148, 149 and 150) will generally be biased downwardly toward 156, thus toward spout 114, when arrangement 122 is supported on frame work 121.

Flap 154 generally helps retain internally received bag 113 in a desired orientation.

Figure 9:
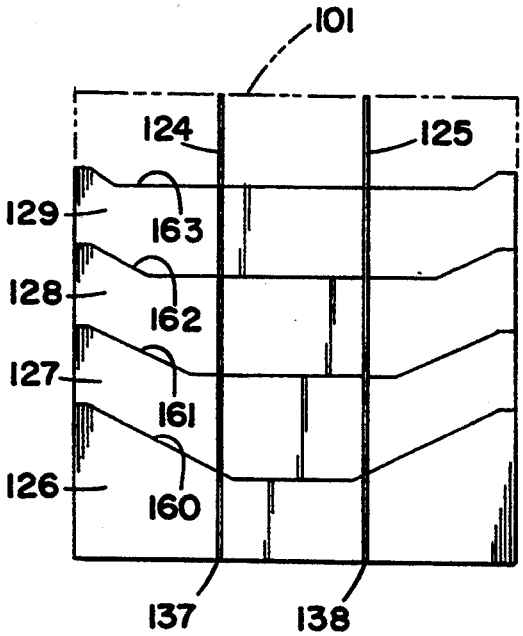
FIG. 9 is a front elevational view of the component shown in FIG. 8.

From a review of FIGS. 7 and 9, it will be understood that each cross-support 126,127,128 and 129, includes an upper edge 160,161,162 and 163, respectively, configured to conform to various contours in arrangement 122. A variety of specific configurations may be utilized, FIGS. 7 and 9 merely provided in the example.

Still referring to FIG. 6–9, it will generally be understood that the angle of decline of edges 131 and 132, and longitudinal guide supports 124 and 125 respectively, between back ends 133 and 134 and front ends 137 and 138, generally define the downward slant of particulate material toward spout 114. For the arrangement illustrated in FIG. 6–9, the angle is selected to be about 40°–50°, to facilitate dispensing of particulate material which requires such an angle, for appropriate flow.

THE ARRANGEMENT OF FIGS. 10 AND 11

Figure 10:
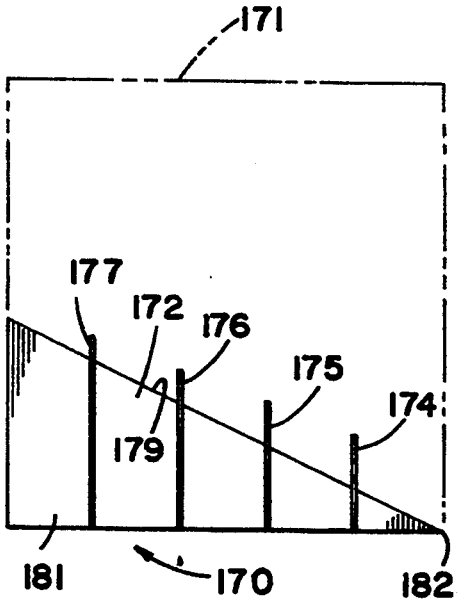
FIG. 10 is a side elevational view generally analogous to FIG. 8, but of an alternate embodiment for the component shown in FIG. 8.
Figure 11:
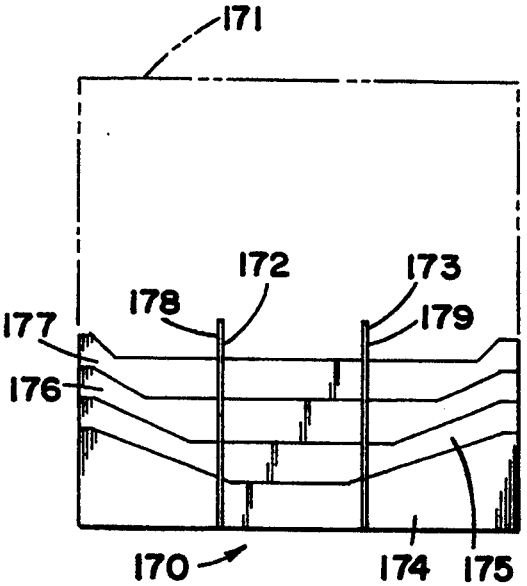
FIG. 11 is a front elevational view of the component shown in FIG. 10.

In FIGS. 10 and 11, an alternate to the arrangement of FIGS. 6–9 as illustrated, to demonstrate that alternate angles of support can be provided. In FIGS. 10 and 11, support pedestal framework 170 is depicted. The framework 170 may be utilized within a carton, such as carton 171 shown in phantom. The support framework 170 may be generally analogous to support framework 121 shown in FIGS. 6–9 except for the angle of decline. Thus, support framework 170 comprises longitudinal guide supports 172 and 173, engaged with and supported by cross-supports 174, 175, 176 and 177.

In FIGS. 10 and 11, an arrangement including an upper wall or dispensing surface, analogous to arrangement 122, FIG. 7, is not depicted. However, it will be understood that a similar folded construction, adapted for the particular angle of support framework 170 in FIGS. 10 and 11, could be readily, and analogously, constructed.

Referring to FIGS. 10 and 11, longitudinal guide supports 172 and 173 each includes an upper edge (178, 179 respectively) which, in decline, from a rear end 181 to a front end 182, FIG. 10, generally define the angle of decline analogously to the angle of decline or dispensation for flow surface arrangement 122, FIGS. 6–9. For the arrangement shown in FIGS. 10 and 11, this angle is at least 20° and is preferably on the order of 20°–30°, an appropriate angle for use with material such as seed corn or the like.

From a comparison of FIGS. 10 and 11 with FIGS. 6–9, it will be generally understood that a wide variety of angles may be utilized with construction to the present invention. The construction can be readily collapsed for shipping and storage as desired. Further, different constructions can (alternatively) be placed within the same container, depending on the particular use of the container.

FIG. 12

The internal components for each of the embodiments described with respect to FIGS. 1–11, can be readily collapsed. That is, internally received bags or bladders, supports, framework or wall arrangements described can be constructed to be readily knocked down and collapsed to be easily handled, stored, and shipped. Indeed, if a fiberboard construction is utilized as the container, the container itself can be readily collapsed or folded for storage or shipping.

Figure 12:
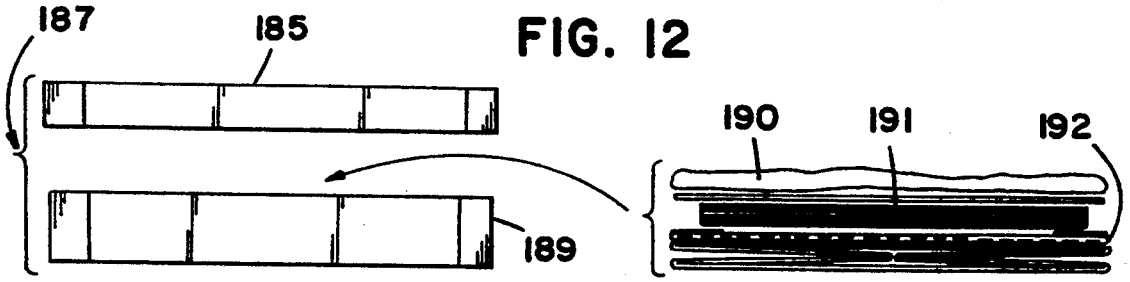
FIG. 12 is an exploded view of an arrangement according to the present invention shown collapsed for storage.

In FIG. 12 this is demonstrated with respect to an embodiment. Referring to FIG. 12, the various components of a shipping container according to the present invention are shown collapsed, to be positioned in a shipping box comprising cover 188 and bottom 189 or the like. The components generally comprise bag 190 (which can be utilized as the plastic bag 6, FIG. 1 ), support construction 191, and carton panels 192. In a remote location, carton panels 192 can be assembled to form a container such as container 1, FIG. 1. Support construction 191 can be assembled, within the container. Plastic bag 190 can be filled with flowable particulate material, and be positioned upon support construction 191. If the support construction comprises a collapsed bladder as illustrated in the embodiments of FIGS. 1–3, when dispensing of particulate material from the container is desired, appropriate inflation can be conducted as illustrated. In the alternative, support construction 191 can comprise a knocked down version of the arrangements shown in FIG. 6–11, which can be readily assembled for permanent support of bag 190 within the container, again directing the flow of particulate material downwardly and toward a dispensing spout as illustrated. It is noted that cover 188 and bottom 189 for shipping box 187 may comprise the cover 185 and bottom of the assembled container (FIG. 1).

FIG. 13

Figure 13:
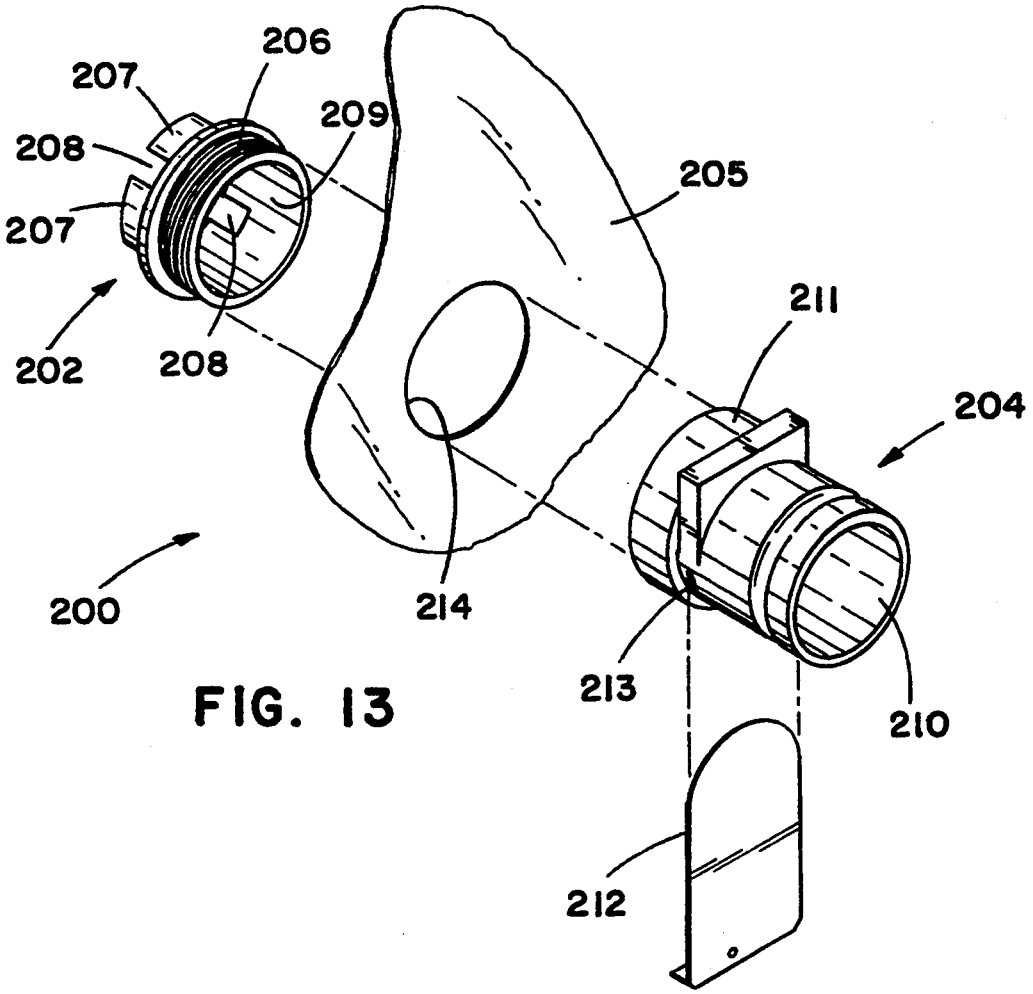
FIG. 13 is an exploded view of an embodiment of a spout arrangement according to the present invention.

Referring to FIG. 13 a preferred spout generally designated 200 is shown. The preferred spout 200 can be used, for example, as the spout 27 shown in FIGS. 1–3. Spout 200 comprises generally an internal member 202 and an external member 204 residing inside of a plastic bag 205 and outside the plastic bag 205, respectively. Internal member 202 includes threaded collar 206; spacers 207; passages 208; and, a particulate conduit 209. The spacers 207 are advantageous in blocking obstructive material from blocking the particulate conduit 209. For example, if a corn husk, or other contaminant in the particulate matter covers the opening between the spacers 207, particulate matter can continue to flow through passages 208 provided between the spacers 207.

In the external portion 204 a female collar 211 includes internal threads (not shown) is adapted to receive the threaded collar 206, to connect the internal particulate conduit 209 with the external particulate conduit 210. A gate 212 is a adapted to be movably received in the gate slot 213 so as to permit opening and closing of the conduit 210. The plastic bag 205 includes an aperture 214.

What is claimed:

1. A container arrangement for storage and dispensing of flowable particulate material; said container arrangement comprising:

(a) a container including a bottom and a wall with a lower dispensing aperture therein; and, (b) means for selectively erecting a slanted dispensing surface operably positioned underneath particulate material received within said container;

(i) said dispensing surface, when erected, being positioned above said container bottom;

(ii) said slanted dispensing surface, when erected, being oriented to dispense particulate material within said container downwardly toward said wall having said lower dispensing surface therein, under influence of gravity;

(iii) said means for selectively erecting a slanted dispensing surface, underneath particulate material, comprising a construction including a pedestal framework and flow surface arrangement; said pedestal framework being constructed and arranged to support said flow surface arrangement with a flow surface thereof slanted downwardly toward said lower dispensing aperture; and, said pedestal framework comprising a plurality of longitudinal guide supports supported by a plurality of cross-supports; each of said cross-supports having a slot therein for engagement with each of said longitudinal guide supports; and, each of said longitudinal guide supports having a slot therein for engagement with each of said cross-supports.

2. An arrangement according to claim 1 wherein:

(a) said flow surface of said flow surface arrangement includes a plurality of slanted surfaces therein.

3. An arrangement according to claim 1 including:

(a) a flexible bag positioned within said container and above said means for selectively erecting a slated dispensing surface.

4. A container arrangement according to claim 1 including:

(a) a spout positioned in extension through said lower dispensing arrangement; said spout comprising: an internal member; and an external member;

(i) said internal member being arranged to be received within an interior of said container arrangement and having a collar with external threads thereon;

(ii) said external member having a particulate conduit portion and a collar portion with internal threads; said collar portion with internal threads being constructed and arranged to engage said internal member collar with external threads, to form a continuous particulate conduit between said internal member and said external member.

5. A container arrangement according to claim 4 wherein:

(a) said external member includes a selectively actuatable gate therein, for selective control of particulate flow through said external member.

6. A container arrangement according to claim 5 wherein:

(a) said dispensing surface has an angle of decline of at least 20°.

7. A container arrangement according to claim 1 wherein:

(a) said dispensing surface has an angle of decline of at least 20°.

8. An arrangement according to claim 1 wherein:

(a) each of said longitudinal guide supports and each of said cross-supports comprises fiberboard.

9. An arrangement according to claim 1 wherein:

(a) said container is a fiberboard box; and, (b) each of said longitudinal guide supports and each of said cross-supports comprises fiberboard.

10. An arrangement according to claim 1 wherein;

(a) said container has a sidewall and includes only one dispensing aperture therein; said dispensing aperture being positioned in said sidewall; and (b) said dispensing surface, when erected, is configured to direct particulate material toward said aperture with an angle of decline of said dispensing surface of at least 20°.

11. A container arrangement for storage and dispensing of flowable particulate material; said container arrangement comprising:

(a) a container having a side wall;

(b) means for selectively erecting a slanted dispensing surface underneath particulate material within said arrangement; said means comprising a pedestal framework and flow surface arrangement; said pedestal framework being constructed and arranged to support said flow surface arrangement with a flow surface thereof slanted downwardly toward said sidewall;

(i) said pedestal framework comprising a plurality of longitudinal guide supports supported in upward extension by a plurality of cross-supports.

12. An arrangement according to claim 11 wherein:

(a) said flow surface of said flow surface arrangement includes a plurality of slanted surfaces therein.

13. A container arrangement according to claim 11 wherein:

(a) each of said cross-supports has a slot therein for engagement with each of said longitudinal guide supports; and, (b) each of said longitudinal guide supports has a slot therein for engagement with each of said cross-supports.

14. An arrangement according to claim 13 wherein:

(a) each of said longitudinal guide supports and each of said cross-supports comprises fiberboard.

15. An arrangement according to claim 13 wherein:

(a) said container has a sidewall and includes only one dispensing aperture therein; said dispensing aperture being positioned in said sidewall; and (b) said dispensing surface, when erected, is configured to direct particulate material toward said aperture with an angle of decline of said dispensing surface of at least 20°.

16. A container arrangement according to claim 13 wherein:

(a) said dispensing surface has an angle of decline of at least 20°.

17. A kit for erecting a container arrangement for storage and dispensing of flowable particulate material; said kit comprising:

(a) a container top;

(b) a container bottom; said container top and bottom being oriented to define a receiving space therebetween;

(c) a knocked down sidewall construction positioned in said receiving space; said knocked down sidewall construction being constructed and arranged to be selectively assembled to form a container, with said container top and said container bottom;

(d) a knocked down dispensing surface construction, for erecting a slanted dispensing surface within the container when erected; said knocked down dispensing surface construction being positioned within said receiving space and comprising a pedestal framework and a flow surface;

(i) said pedestal framework comprising a plurality of longitudinal guide supports and a plurality of cross-supports.

* * * * *

UNITED STATES PATENT AND TRADEMARK OFFICE
CERTIFICATE OF CORRECTION

PATENT NO. : 5,335,820

DATED : August 9, 1994

INVENTOR(S) : Lee O. Christianson

It is certified that error appears in the above-identified patent and that said Letters Patent is hereby corrected as shown below:

Column 7, line 15, after the numeral "3.", delete --3--.

Signed and Sealed this

Fifth Day of March, 1996

*Attest:*

Bruce Lehman

BRUCE LEHMAN

*Attesting Officer*

*Commissioner of Patents and Trademarks*